United States Patent [19]

Saunders

[11] 4,291,565

[45] Sep. 29, 1981

[54] WIRE DRAWING DEVICE

[75] Inventor: Albert A. Saunders, Bellefonte, Pa.

[73] Assignee: ASA Enterprises, Inc., Wis.

[21] Appl. No.: 68,788

[22] Filed: Aug. 22, 1979

[51] Int. Cl.[3] ..... B21C 1/30

[52] U.S. Cl. ..... 72/290; 72/285; 72/24

[58] Field of Search ..... 72/290, 285, 19, 20, 72/24

[56] References Cited

U.S. PATENT DOCUMENTS

| | | | |
|---|---|---|---|
| 3,260,084 | 7/1966 | Mersek | 72/20 |
| 3,260,085 | 7/1966 | Mersek | 72/20 |
| 3,260,086 | 7/1966 | Prutton | 72/285 |
| 3,290,916 | 12/1966 | Louis et al. | 72/285 |
| 3,654,784 | 4/1972 | Alcock et al. | 72/5 |

*Primary Examiner*—Daniel C. Crane

*Attorney, Agent, or Firm*—Wheeler, House, Fuller & Hohenfeldt

[57] ABSTRACT

A programmable and self synchronizing wire drawing device includes a stationary sleeve member having a bore. A work cylinder having an end cap piston at each end is axially reciprocable in the bore. The piston diameters equal the diameter of the bore and the cylinder diameter is less than that of the bore so the wall of the bore and the outside of the work cylinder define an annular air space that is closed at its ends by the pistons. An annulus is fixed within the annular space between the pistons. A wire gripper is supported from one piston at a distance therefrom. A hydraulic piston is reciprocable within the work cylinder and it is on a tubular piston rod which extends slideably and sealingly through the end cap pistons. A wire drawing die is mounted on the end of the piston rod which is nearest the gripper. The hydraulic and air driven pistons cooperate to draw wire and feed segments of it to a consuming machine. An adjustable cam assembly, a pair of limit switches, a solenoid operated air valve, a spring-offset solenoid operated hydraulic valve and hydraulic and air pressure regulators are involved in programming the device to meet any set of operating conditions.

11 Claims, 11 Drawing Figures

WIRE DRAWING DEVICE

This invention relates to a device for drawing or reducing the cross sectional area of bar, rod, wire stock and the like and for feeding successive segments of the drawn stock into a consuming machine. Typical consuming machines are those which roll or cut threads on the drawn wire segments or form heads on the segments as is required for making bolts, but the new device is adapted for use with any wire consuming machine that is equipped with a stop for establishing the length of the segments as they are fed in or that is equipped with a feed device for pulling in successive lengths of drawn wire.

The improved wire drawing device is in a class characterized by feeding rod stock into the device from a reel or other source, by gripping the rod and pulling or pushing a drawing die over it and then feeding a portion of the wire into a consuming machine followed by retracting the die and gripper to repeat the cycle when the wire is consumed. Some examples of devices in this class are shown in U.S. Pat. Nos. 3,260,084; 3,260,086; 3,290,916 and 3,654,784.

Designers of prior wire drawing devices inevitably encountered problems which, insofar as can be presently ascertained, were not resolved until the device described herein was developed. One of the problems was to obtain synchronous and non-conflicting cooperation between the wire drawing device and the consuming machine. One approach to solving this basic problem has been to use power driven feed rolls at the wire inlet of the consuming machine to pull wire into the machine on an as-required basis and then have the consuming machine operate switches, or valves or mechanical linkages for governing operation of the drawing device. This interaction between the wire drawing device and the consuming machine can result in shocks or impacts in one or the other or both of them, in vibration, wear, nonuniform feed, loss of synchronism, premature degradation and, not impossibly, in destruction of the wire drawing device or the new consuming machine or both. In some designs complex electromechanical, pneumatic and hydraulic control systems were built into the wire drawing device in an effort to synchronize its operation with the consuming machine. As complexity of the controls increases, of course, ostensible solutions to the problems may be achieved but, in the last analysis, reliability necessarily declines with complexity.

SUMMARY OF THE INVENTION

An object of the present invention is to provide a wire drawing device which performs its feeding and drawing functions entirely independently of the mode in which the consuming machine functions. An adjunct to this object is that the new and improved wire drawing device may be used to supply drawn wire to a wide variety of consuming machines including those which use feed or pinch rolls or jaws to pull the drawn stock in and those which do not.

Another object is to provide a device in which the numbers of parts is minimized and the masses of those parts which are used are minimized and in which all of the significant movable mechanical and hydraulic parts are adapted for executing linear motion with a concomitant minimization of wear, vibration and shocks.

Another object is to provide a device which can be programmed, that is, set up for delivering drawn segments of wire stock to a consuming machine with selected lengths and speeds and with a minimum of skill being required by the set-up person.

Another object is to provide a device which will maintain its operating parameters constant and require little, if any, attention during a production run.

A further object is to provide a preferred embodiment of a wire drawing device in which all of the essential parts are concentric, annular and coaxial such that they can be made with the simplest single axis metal working machine such as lathes and drill presses with a minimum of machining skill being required.

Another object is to provide a drawing device in which a number of parts perform dual functions which results in minimizing mass and, hence, a reduction in accelerating and decelerating forces.

Another object is to provide a device which imposes no physical load on the drawn wire consuming machine and which is self-adjusting and requires no mechanical, electrical or hydraulic inter-relationship with the consuming machine.

Briefly stated, the improved wire drawing device has a wire feeding unit cooperating with a wire drawing unit although some of the parts of one are common to the other. In the preferred embodiment, the units are mounted in the bore of a sleeve member which is on a fixed stand. A work cylinder, which participates in both wire feeding and drawing, is subject to internal pressurization with hydraulic fluid and external pressurization with air, and is disposed for moving axially within the fixed bore of the fixed sleeve. There are caps on opposite ends of the work cylinder and these caps have an outside diameter equal to the inside diameter of the fixed sleeve member so they can slide snuggly in the sleeve member and serve as pneumatic pistons for translating the work cylinder axially when the space around it is pressurized with air and for effecting shock-free deceleration of the parts at the end of each working stroke.

The main elements of the drawing unit are a piston which moves inside of the work cylinder when it is subjected to hydraulic pressure on its opposite sides. The piston is fixed on an axially movable piston rod which extends in sealing fashion through the end cap pistons and has a wire drawing die attached to one end. The piston rod is hollow so wire can pass through it. A hollow cylindrical element is fastened to one end cap piston of the work cylinder and extends axially from it. A wire gripper is mounted on the free end of the hollow cylindrical element for gripping the wire during the wire drawing operation.

Wire feed to the consuming machine from the drawing device is initiated by pressurizing the exterior of the work cylinder and, hence, one end cap piston with air while simultaneously or subsequently applying hydraulic pressure to the interior of the work cylinder for obtaining a unique self-compensating action. At the end of a wire feed stroke, the work or feeder cylinder is decelerated and cushioned with air and is retracted with air pressure or a combination of air and hydraulic pressure after which hydraulic pressure is applied reversely to the piston in the cylinder to cause the die to draw a segment of wire which is approximately the length of the segment fed to the consuming machine thereby essentially replenishing an ample stock of drawn wire so the feed operation can be effected perfectly.

Only one double-acting pneumatic valve and one double-acting hydraulic valve are used in the system. These valves are governed by action of the wire drawing machine itself, in a manner which may be characterized as internal feedback so the parts of the device are maintained in self-compensating phase relationships independently of the consuming machine. The functional characteristics of the device are fully programmable.

How the foregoing objects and other more specific objects and advantages of the invention are achieved will be evident in the ensuing more detailed description of a preferred embodiment of the invention which will now be set forth in reference to the drawings.

DESCRIPTION OF A PREFERRED EMBODIMENT

Figure 1:
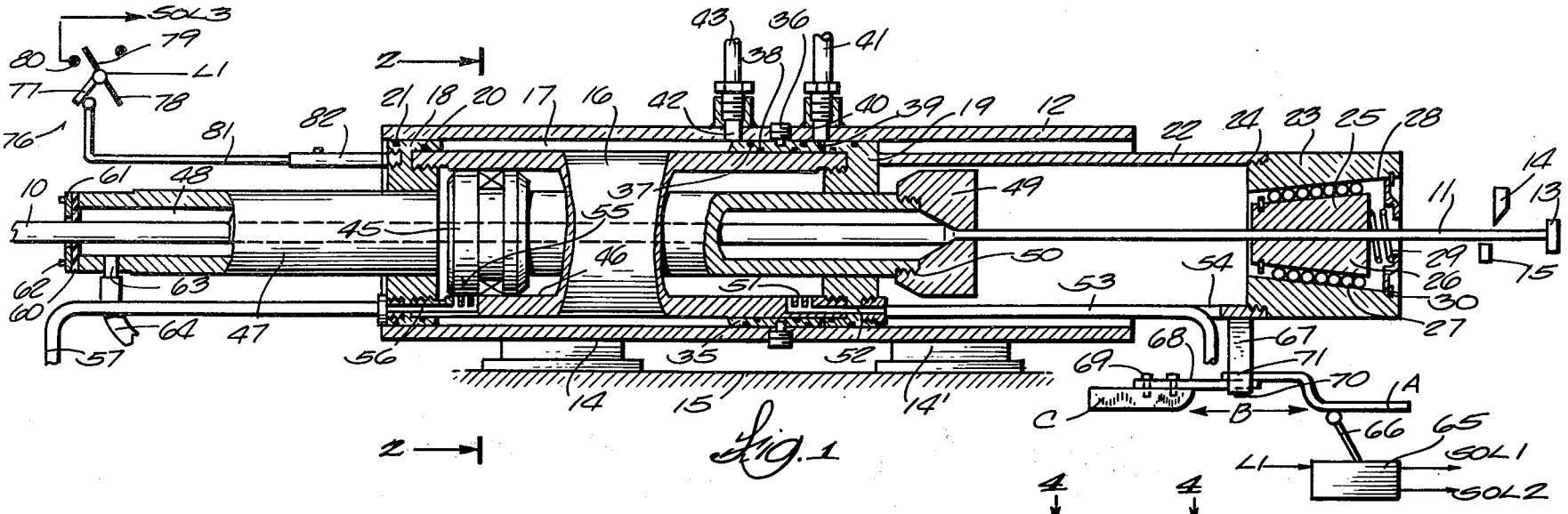
FIG. 1 is a side elevation of the improved drawing device which is shown with parts in section and parts broken away and with the wire gripper and die of the drawing unit in separated position.
Figure 2:
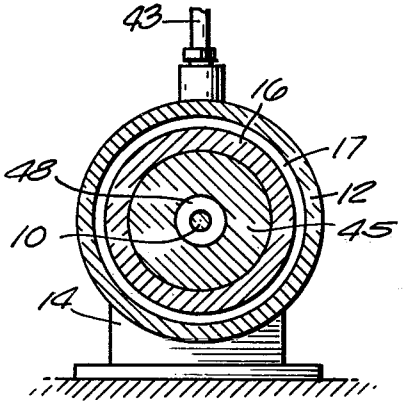
FIG. 2 is a vertical section taken along a plane corresponding with 2—2 in FIG. 1.

As the drawing device is oriented in FIG. 1, undrawn rod 10 feeds in from the left end and that portion 11 of the rod which has had its cross sectional area reduced or drawn feeds out of the right end toward a machine which consumes and uses segments of drawn wire. Generally, the rod stock 10 is withdrawn from a coil of rod on a reel which is not shown but which is the customary source of rod for drawing devices of the type under consideration. At the right end of the device where the drawn wire 11 is fed out, some elements of an illustrative consuming machine are shown diagrammatically. In this example, one of the consuming machine elements is an end stop 13 which is spaced from a shear blade 14 that cooperates with an anvil 15 for cutting drawn wire 11 into segments having lengths suitable for making the part which the consuming machine is set up to make.

With the improved drawing device, it is only necessary to have some kind of a stop such as the one marked 13 for determining the length of the wire segments and this is the only interaction between the wire drawing device 10 and the consuming machine. In most prior art drawing device and consuming machine combinations the drawn wire runs between the peripheries of power driven feed or pinch rolls or jaws, not shown, which exert a frictional or cinching force on the drawn wire to pull it from a drawing device and push it into the consuming machine. One known prior wire drawing device does operate independent of the consuming machine but it has some impact or shock problems which are inherent in its design. The improved drawing and feeding device described herein, however, may be used with a consuming machine that has or does not have a self-feeding mechanism.

The wire drawing and feeding device in FIG. 1 comprises a tubular member or sleeve 12 which has a finished internal bore and acts as a stationary air cylinder. As shown diagrammatically, sleeve 12 is held stationarily by virtue of it being fastened to legs 14' and 14 which are mounted fixedly to the earth. An axially reciprocable work cylinder 16 is internally concentric with the bore of outer fixed sleeve 12. The outside diameter of cylinder 16 is less than the inside diameter of sleeve 12 to thereby define an annular volume 17 which is subject to air pressurization and depressurization during operation of the device as will be explained. The rear end of cylinder 16 is closed with what may be called a header or end cap which is threaded onto the cylinder and serves as pneumatic piston 18 that is slideable axially with the cylinder in the sleeve. There is a similar end cap piston 19 threadingly fastened to the front end of cylinder 16. Piston 18, for example, is sealed with respect to cylinder 16 with a seal 20 to negate any leakage through the threads. The outer periphery of end cap piston 18 is provided with a seal 21 which serves as a piston ring to effect sealing relationship between the outer periphery of the air piston 18 and the inner surface of outer fixed sleeve 12. End cap piston 19 is constructed similar to piston 18 and has a similar piston ring seal as shown.

A hollow cylindrical element 22 or gripper support is fastened as by welding to front end cap piston 19. A cylindrical wire gripper body 23 is fastened by means of threads 24 to the end of cylindrical element 22. The gripper may be a conventional type comprising two or more internally longitudinally grooved and externally conically shaped gripper jaws such as those marked 25 and 26. The conical jaws are surrounded along their lengths with a multitude of hard metal balls 27 which facilitate slight axial movement of the jaws in the conical bore 28 of the gripper body. The jaws wedge in the ball lined conical bore 28 and grip the drawn wire stock when that part of the stock within hollow cylindrical element 22 is under tension and the jaws release their grip on the drawn wire when its tension is relieved. The gripper jaws are normally biased into gripping relationship by means of a spring 29 that reacts against a fixed retainer ring 30.

From the description thus far, it will be seen that work cylinder 16, its associated end cap pistons 18 and 19, hollow cylindrical element 22 are unitary and constitute a wire feeding unit which is axially reciprocable in stationary external sleeve or cylinder 12.

The elements for advancing and retracting the wire feeding unit axially with air pressure and for cushioning the work cylinder at the end of each reciprocation will now be described. One of the elements involved is a ring or annulus 35 which is fixed internally and concentrically to outer fixed sleeve 12 with a plurality of set screws such as the one marked 36. A seal which may be an o-ring 37 seals the outside of annulus 35 which respect to the inner surface of fixed sleeve 12 and another seal 38 acts as a stationary piston ring to seal between the inner periphery of stationary annulus 35 and the outer periphery of axially slideable cylinder 16. The ends of annulus 35 are beveled radially so as to produce a beveled circumferential gap such as the one marked 39 which is created where stationary annular member 35 is adjacent to end cap piston 19 as shown in FIG. 1. This gap presently aligns with a port 40 which connects to one of the air conducting tubes 41. There is another port 42 coupled to another air conducting tube 43 by means of the illustrated compression fitting. Just by way of preliminary explanation, it will be evident that when air pressure is applied to gap 39 from tube 41, the pressure will also be applied to end cap piston 19 which will cause piston 19 and the other parts of the feeder unit attached to it to translate to the right in FIG. 1 until stopped by means and actions of the parts which will be discussed more fully later when the operating mode of the device is described. It will also be evident that after the unit is driven to the right with air pressure, it can be returned or retracted to the left by applying air pressure through the other tube 43 to the gap which will then exist between the left beveled edge of annular member 35 and the small radially extending inside face of end cap piston 18. This generally outlined cyclic pressurizing and exhausting of air through the respective tubes 41 and 43 is involved with the wire feeding action of the device although it has some more subtle aspects as also will be discussed later in connection with describing the operating mode of the device. The manner in which air pressure on end cap pistons 18 and 19 is governed during operation of the device to obtain controlled deceleration and cushioning of the linearly reciprocating parts will also be discussed in detail later. Observe that annulus 35, being stationary, serves as an object against which air pressure reacts to push the end cap pistons in one direction or another and, hence, it acts like the converse of a typical movable connecting rod since it causes the end cap pistons to move when the space 17 on either side of the annulus is subjected to air pressure.

The wire drawing unit comprises a hydraulically operated piston 45 which is axially movable within the internal bore 46 of work cylinder 16. Piston 45 is fastened to a piston rod 47 which has a bore 48 through which the undrawn rod stock 10 passes. A wire drawing die 49 is fastened by means of threads 50 to the end of piston rod 47.

Piston 45 is subjected to hydraulic pressure selectively on its opposite sides for advancing and retracting it together with piston rod 47 and the die 49. To push the piston 45 to its leftmost position as it happens to be in FIG. 1, hydraulic pressure is applied to the internal volume 46 of cylinder 16 which is on the right side of piston 45. This pressure is applied through a series of three holes which are graduated in size and are collectively marked 51 at the right end of cylinder 16 in FIG. 1. These holes jointly form a port which leads to a hole 52 that connects to a tube 53 by means of the illustrated threaded compression fitting. Thus, hydraulic fluid may be supplied to and exhausted from the bore 46 of cylinder 16 through port 51 and the hole 52 in end cap air piston 19. Tube 53 is rigid and connects to the flexible hose which is not shown in FIG. 1. This tube is disposed in a slot 54 of cylindrical element 22 and does not interfere with axial movements of the feeder within stationary cylindrical support cylinder 12.

The left end of hydraulic cylinder 16 is similarly provided with three holes which are collectively marked 55 to indicate they serve as a fluid transfer port. Port 55 leads to a hole 56 through end cap piston 18 and then to a rigid tube 57 which is connected to a flexible hose, not shown in this figure.

Figure 3:
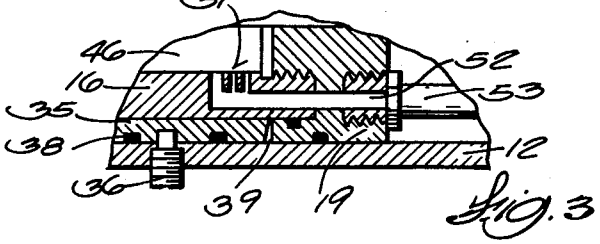
FIG. 3 is an isolated fragmentary view of one of the hydraulic fluid ports of the device in FIG. 1.
Figure 4:
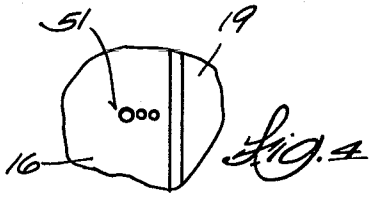
FIG. 4 is a plan view of the varying sized hydraulic fluid port holes of the FIG. 3 elements.

The port 51 holes associated with end cap piston 19 are easily visible in the enlarged fragment in FIG. 3. As can be seen in this figure and in FIG. 4, the holes composing port 51 decrease in size as one progresses from the left toward the inside face of end cap piston 19. Thus, when hydraulic piston 45 is driven to near the end of its travel toward the right, the largest hole in the port group 51 is encountered and covered first by the piston 45 to thereby initiate gradual deceleration and then the next smaller holes are successively closed to further decelerate the piston. This arrangement assures that fluid relief or discharge between hydraulic piston 45 and end cap piston 19 near the end of the piston stroke will not be shut off instantaneously so as to avoid trapping an incompressible fluid which would otherwise produce the effect of striking a dead end suddenly. This, piston deceleration is always gradual. When hydraulic fluid is being fed in through the same ports at another time in an operating cycle, the opposite effect is achieved, that is, acceleration is gradual at the beginning by virtue of the smallest of the ports being the first one to start fluid feed with minimum impulse effect and the larger ports open in sequence when the piston has achieved some speed already. The port 55 at the opposite end of cylinder 16 performs a similar function for opposite relative movement of the hydraulic piston 45 and end cap piston 18 at the other end of the feeder and drawer. Port 55 acts as fluid discharge port during a wire drawing stroke by piston 45, wherein the piston moves to the left within cylinder 16, and at this time port 51 acts the pressurized hydraulic fluid input port. The wire drawing portion of a wire drawing and feeding cycle is faster than the feed portion because of the way the hydraulic pressure is controlled. A suitably shaped elongated slot could be used for the three hole port to obtain regulated acceleration and deceleration at the start and end of the wire drawing piston stroke.

Undrawn rod 10 is fed into axial bore 48 of hydraulic piston rod 47 through a flexible seal 60 which effects a wiping and sealing action on rod 10. Flexible seal 60 is held to the end of piston rod 47 with a flat ring 61 and several screws 62. A tube 63 communicates with core 48 of piston rod 47. Tube 63 is connected to a hose 64 through which is fed a viscous lubricant or a lubricating powder which fills bore 48 and is available for lubrication of the die 49 and rod stock 10.

In FIG. 1, the device is provided with a cam and limit switch assembly for controlling application and exhaust of air on connection with the drawn wire feeding and feeder retraction operations. The limit switch 65 is shown diagrammatically as having an operating lever arm 66 and an electric supply or input line marked L1 and two output lines leading to solenoids SOL1 and SOL2 in FIG. 5 and these lines are similarly identified in FIGS. 1 and 6–10. Limit switch 65 has a spring-centered lever arm 66 which opens both output lines when centered. It makes momentary contact or circuit closure in each direction when it is cammed and has a nominal amount of free travel in each direction. It controls the solenoids, SOL1 and SOL2 of a double acting air solenoid valve 101 shown in FIG. 5.

Limit switch 65 is actuated by cams which are symbolized as being mounted on a post 67 extending from cylindrical gripper supporting element 22 of the feeder unit. One cam part is marked A and the other is marked C and the space between them is designated by the letter B. Cam C is mounted on a bar 68 with screws 69. The bar goes through a slot in post 67 and is retained with a socketed set screw 70 to thereby make cam C and, hence, space or gap B adjustable. Cam A is secured at the time of manufacture in post 67 with a set screw 71. Cam A need not be adjustable since it is involved in the retraction of feeder cylinder 16 which always goes to the same limit.

Also shown in the upper left region of FIG. 1 is a schematically represented maintained contact type of limit switch assembly which is generally designated by the reference numeral 76. The maintained contact type of limit switch is represented symbolically as having two tripping arms 77 and 78 and a contact arm 79 which can be caused to make and break with an electric contact 80 that is connected to an output line which leads to solenoid 3 (SOL3) in FIG. 5 as will be discussed in more detail subsequently. Limit switch contact 79 in FIG. 1 also connects to an electric supply line L1. This limit switch is shown schematically to be actuated by an arm 81 which is mounted to header or end cap piston 18. Arm 81 is adjustable in length by virtue of it being held with a screw in a sleeve 82 which is screwed into one face of end cap piston 18.

Before departing from FIG. 1, it may be noted that wire drawing die 49 exerts a powerful gripping force on the cross sectionally reduced portion 11 or drawn portion of the rod stock. When the feeder unit is advanced this grip or bite by the die is maintained and is used to push the drawn wire toward the consuming machine.

Figure 5:
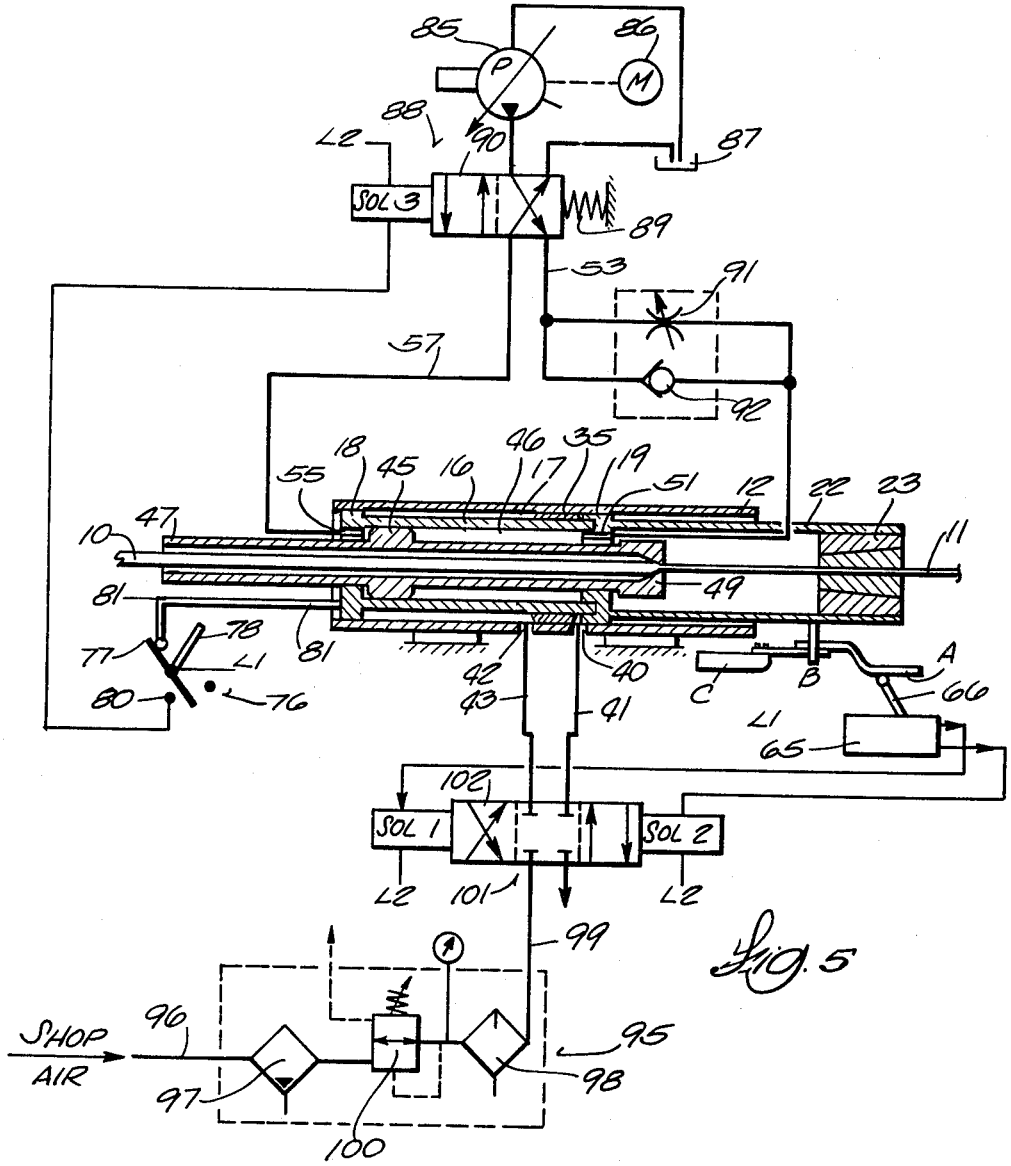
FIG. 5 depicts the wire drawing and feeding device in section affiliated with the schematically represented hydraulic and pneumatic control circuits for the device.

In FIG. 5 the wire drawing device is shown diagrammatically in conjunction with its simple hydraulic and pneumatic control systems. The hydraulic system comprises a pressure compensated variable volume pump 85 driven by a motor 86. The pump draws oil from a reservoir 87 and supplies it to a single solenoid spring-offset directional control valve which is generally identified by the numeral 88. The valve solenoid is designated as SOL3 on the drawing and the return spring has the numeral 89. The valve body is marked 90. As shown, the solenoid is deenergized and the presently fully expanded spring 89 holds the valve body 90 as shown. One hydraulic fluid line from valve 88 to the drawing device is marked 57 and the other is marked 53 as they are similarly marked in FIG. 1. The three-hole or slotted port 55 of FIG. 1 is shown in FIG. 5 as a single hole 55 going through end cap piston 18. The other hydraulic port 51 is similarly shown as a hole passing through the other end cap piston 19 of the drawing device feeder.

In line 53 between valve 88 and the drawing device there is a flow regulator comprised of a uni-directional adjustable throttle 91 and a check valve 92. During the draw stroke by hydraulic piston 45 when it is moving to the left inside of cylinder 16, flow is unrestricted through the regulator or to the right in FIG. 5 and full hydraulic pressure and flow is applied to the piston 45 so the wire draw stroke is very fast. During piston 45 retract, check valve 92 closes and flow is regulated or restricted by means of throttle 91 so this stroke is relatively slower. Line 57 is pressurized during retract. All of the parts shown in FIG. 5 correspond with the positions which they are in during and at the completion of a wire drawing stroke. Thus, piston 45 and die 49 are fully retracted from gripper 23 so that the maximum length of drawn or reduced wire exists between the die and gripper 23 in this case. Combination hydraulic and pneumatic cylinder 16 is fully retracted to the left in FIG. 5. The device is now ready to deliver a segment of drawn wire to the feeder and subsequently to the consuming machine. It should be noted that when full retract of air actuated cylinder 16 was reached prior to the start of a piston 45 draw stroke which is shown at its end in FIG. 5, hydraulic limit switch 76 is operated to open condition to deenergize SOL3 of the valve 88 which is deenergized during a draw stroke and becomes energized after a feed stroke has begun because cylinder 16 is started to move to the right under the influence of air pressure at that time.

The pneumatic control system comprises a pressure regulator which is encompassed by the dashed line rectangle 95 in FIG. 5. The unregulated air input line is marked 96. The regulator combination includes a filter 97 and a device 98 for injecting lubricant mist into the air stream which goes out of output line 99. The regulating valve itself is marked 100 and is symbolized as being adjustable to produce the desired output pressure on line 99.

The pneumatic circuit includes a double acting blocked center solenoid valve 101 whose body 102 is shiftable with solenoids SOL1 and SOL2. The valve is presently shown with both solenoids deenergized since pneumatic control limit switch 65 has been opened as a result of the feeder cylinder 16 still being fully retracted at the end of a draw stroke as in FIG. 5. What has previously happened is that pressure has been applied through line 43 and pneumatic port 42 to pressurize air chamber 17 and exert a force on the end cap piston 18 to drive work cylinder 16 to its leftmost or full retract position in readiness for feeding wire. In other words, valve body 102 has just returned to its neutral position after having been shifted to the left wherein the parallel paths in the body had been aligned with lines 43 and 41 in which case 43 was pressurized and line 41 was exhausting.

Earlier, it was indicated that an object achieved with the improved wire drawing device is to negate the mass or inertia of the feeder and drawing elements and the inertia of the rod stock feed reel so that wire could be fed to the consuming machine without requiring any appliance on the consuming machine for pulling wire in and without imposing any load on the consuming machine. This object is achieved through the programmable characteristic of the pneumatic system and feeder which will now be discussed.

As indicated earlier, the position of the parts in FIG. 5 corresponds with piston 45 and die 49 just having completed a wire drawing stroke such that the device is in readiness for delivering a supply of drawn wire 11 to the consuming machine. FIG. 5 may also be used to demonstrate how the pneumatic system is programmed and how the device is initialized or set up for operation with all inertia, drag and masses compensated or balanced out.

The initializing procedure includes threading the end of the undrawn rod stock 10 from the unshown supply reel into the drawing device. Since undrawn rod will not fit through the hole in die 49 at this time a piece of wire that will fit through may be welded onto the rod as a leader and the leader may be fed through the die 49 and gripper 23 too. The drawer device is then operated through a few cycles under manual control of the valves until enough wire is drawn for its end to reach the stop 13 in the consuming machine. The die 49 is then biting the rod stock tightly. It is assumed that the drawer device is next to the consuming machine at this time. The air pressure for driving the feeder is then adjusted by way of regulator 100 until output pressure of the regulator becomes sufficient to start slowly moving the feeder, that is, the mass of the hydraulic piston 45 and its associated parts, the mass of cylinder 16, the mass of hollow cylindrical gripper supporting element 22 and the mass of gripper 23 slowly to the right. Movement of the feeder indicates that its inertia and that of the feed reel has been overcome or compensated in which case the pressure regulator 100 is allowed to remain at the setting which corresponded with movement. This same air pressure is applied in proper timing during operation of the device so that the mass or inertia of the device and everything affiliated with it are compensated at all times.

The maximum length of the feed stroke, which is desirably just a little greater than the length of the drawn wire segments which are being consumed by the machine, is also programmable by adjusting the limit switch 65 operating point in FIG. 5. Essentially, this involves adjusting the position of cam C to establish a predetermined distance B. Distance B corresponds with the time during which no external air pressure is applied to the feeder in a normal operation cycle. This is when the trapped air effects a balancing and cushioning effect as will be explained.

Now that set-up of the machine and programming of the feed air pressure to account for inertia and feed stroke length have been described, it is appropriate to demonstrate a complete operating cycle in reference to FIGS. 6–10. After this is done, a more detailed description of how the limit switches function to control the pneumatic and hudraulic feed and draw elements will be given.

An assumption is made that the device is properly programmed for segment feed length and mass compensation, that is, the air pressure and the air and hydraulic systems have been properly adjusted so that the device will operate automatically without requiring attention during a production run.

Figure 6:
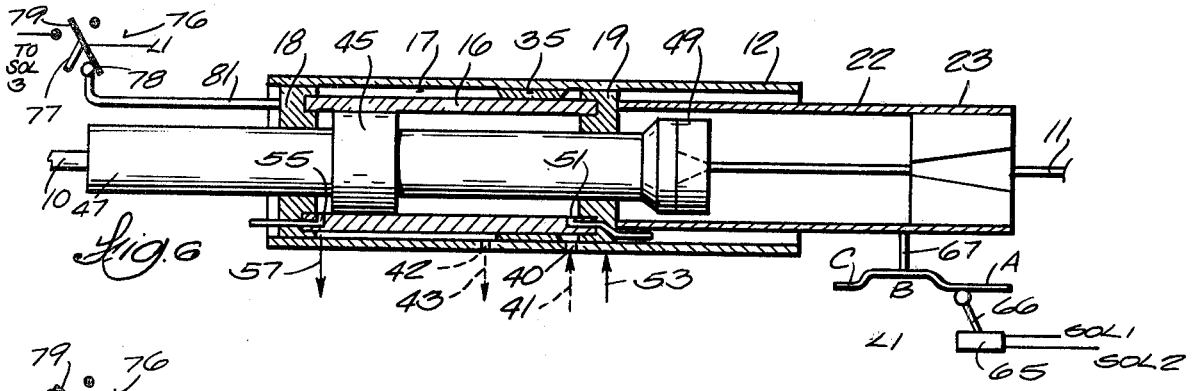
FIGS 6–10 are schematic diagrams of the device in various stages of operation.

In FIG. 6 the parts of the wire drawer are shown in the positions they are in when drawing of a length of wire is just being completed and the device is just about to go into readiness for feeding the next segment required by the consuming machine. In FIG. 6, hydraulic fluid flow at the moment under consideration is indicated by solid arrowheaded lines 53 and 57 which correspond in number to the tubes or oil lines leading from hydraulic solenoid and spring operated valve 88 in FIG. 5, the arrowheads indicating flow direction. Air flow at the moment is indicated by arrowheaded dashed lines 41 and 43 which correspond in number to the lines leading from the double solenoid air valve 101 in FIG. 5. The same fluid and air flow identification is followed in FIGS. 7–10.

The drawn wire 11, in FIG. 6, is still gripped by the gripper 23 and die 49 has a bite on the rod. Feeder cylinder 16 and its end cap or headed pistons 18 and 19 are fully retracted to the left. Hydraulic piston 45 is also fully retracted to the left and a length of wire 11' has been drawn and extends between die 49 and gripper 23. Hydraulic control switch 76 is still open which means that the solenoid (SOL3) in FIG. 5 is still deenergized. Thus, hydraulic valve 88 is still shifted to the left under the influence of expanded spring 89 and hydraulic fluid pressure is still being applied to the right side of piston 45 from line 53 through hydraulic port 51. Hydraulic fluid has been exhausting during the wire draw stroke through line 57 back to valve 88. Fluid feed for draw has been in the free flow direction through check valve 92 during the draw stroke in order to apply full power at that time so a segment will be drawn in part of a second.

In FIG. 6, the air control switch 65 is shown with its operating arm on cam A already so air valve solenoid (SOL1) is energized already and air pressure is applied from air line 41 through port 40 for initiating movement of the feeder cylinder 16 to the right. Actually when cylinder 16 was retracted to the position in which it is shown in FIG. 6, that is, prior to the time hydraulic piston 45 was driven during the draw stroke to the position in which it is shown in FIG. 6, atmospheric air became trapped and compressed in the space between annulus 35 and end cap piston 19. This trapped air served as a cushion for gradually decelerating feeder cylinder 16 at the end of its retract stroke. Moreover, the trapped and compressed air in the space between annulus 35 end cap piston 19 is present for initiating the next feed stroke which means initiating movement of cylinder 16 to the right if the consuming machine demands a segment of wire at this time. Exactly how the pressures on each side of annulus 35 are controlled with cam operated double solenoid air valve 101 will be discussed more extensively in connection with describing a subsequent step.

As cylinder 16 starts to move to the right in FIG. 6 it will tend to carry the hydraulic piston 45 and die 49 with it to the right. Since die 49 is seized to the wire, the initial joint movement of piston 45 with die 49 and cylinder 16 with gripper 23 will result in beginning of wire 11 feed to the consuming machine.

Figure 7:
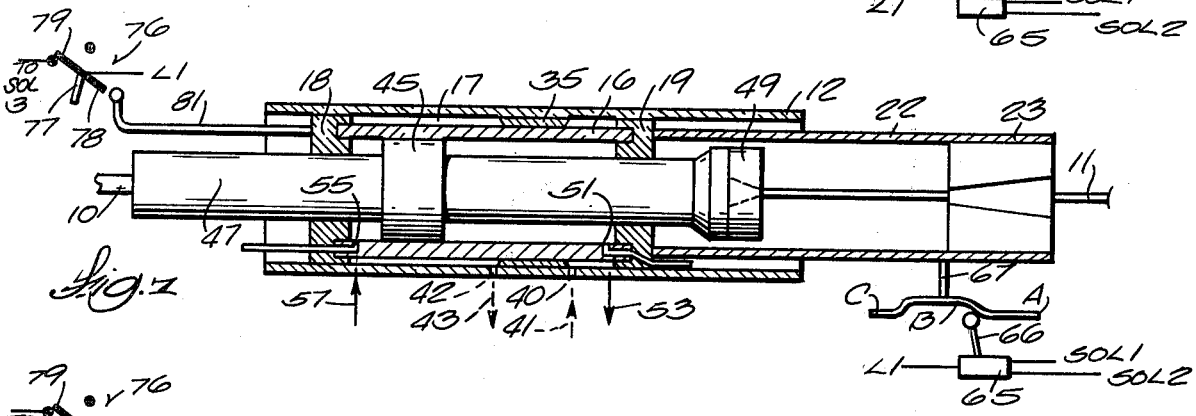

In FIG. 7, feed of drawn wire 11 to the right, that is, to the consuming machine, is underway. Operating lever 66 of the air limit switch 65 is still on cam A but ready to drop off so SOL1 of air valve 101 in FIG. 5 is still energized and its cross paths are aligned with tubes or lines 41 and 43. This results in continuation of the application of the air pressure through port 40 in FIG. 7 to end cap piston 19 and it separates further from annulus 35 and wire feed cylinder 16 is being pushed to the right. Drawn wire is being fed to the right because gripper 23 has not yet released. At the moment shown in FIG. 7, air port 42 is still exhausting as indicated by the dashed arrow 43.

Figure 5A:
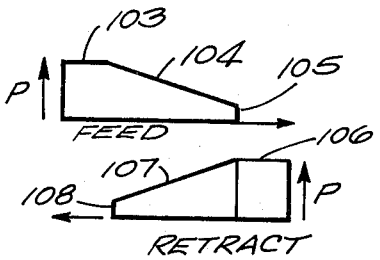
FIG. 5A is a diagram of pneumatic pressure conditions during feed advance and feed retract operations of the device.

Air pressure conditions are illustrated in the FIG. 5A diagrams. The line 103 indicates that full air pressure is applied to end cap piston 19 while the air limit switch in FIG. 7 is still on cam A. As will be evident in FIG. 5A, in the next phase of the wire feed operation on the diagram labeled "feed," when the air limit switch lever 66 gets off of cam A, air feed through port 40 will stop and pressure will begin to decline, as indicated by line 104 in FIG. 5A, in the volume between annulus 35 and end cap piston 19. While full pressure is still on end cap piston 19, the left side of annulus 35 is exhausting in FIG. 7 as shown by the absence of pressure in the diagram labeled "retract" in FIG. 5A. To repeat, when air pressure is applied through port 40 in FIG. 7, cylinder 16 and die carrying piston 45 begin to move to the right to start feeding drawn wire.

Since feeder cylinder 16 has begun to move to the right in FIG. 7, hydraulic limit switch control arm 81 has translated and has tripped hydraulic limit switch 76 to energize SOL3 of spring-offset hydraulic control valve 88, thereby shifting the valve to the right from the position in which it is shown in FIG. 5. In FIG. 7, this results in highly pressurized hydraulic fluid being forced through line 57 and port 55 to the inside of cylinder 16 and to the left of hydraulic piston 45. The hydraulic fluid pressure is high compared with air pressure. This hydraulic pressure acts on piston 45 of the drawer unit tending to force it to the right but the pressure also reacts on the inside of the left end cap piston 18 tending to force it and cylinder 16 to the left so there may be some reverse movement of cylinder 16. In effect, this simply results in drawn wire being transferred from the drawer, that is, from the piston 45 and die 49 assembly, to the feeder and feed of wire to the consuming machine does not stop. Die 49 and gripper 23 simply move relatively closer to each other and the gripper is released and the bite of die 49 is solely effective to advance the wire. At this point there is a mutual counterbalancing of pneumatic and hydraulic forces with the effect that the pneumatic force controls and produces the programmed feed function.

In FIG. 7, while fluid is being fed through port 55 to the left side of piston 45, the position of spring-offset valve 88 is such that hydraulic fluid is being exhausted from cylinder 16 on the right side of piston 45. This is not a zero pressure exhaust because some pressure is maintained by virtue of exhaust flow being through the throttling regulator 91 in FIG. 5 while check valve 92 is held closed by return fluid flow. The fluid pressure between drawer piston 45 and the inside of end cap piston 19, therefore, assists in driving feeder cylinder to the right.

One should recall that when the wire drawing device was being set up for a production run, air pressure was programmed or adjusted, by using regulator 100, to a level where the pressure was just sufficient to overcome the drag of the rod supply reel and to propel the entire feeder and drawer mass toward the consuming machine while feeding a segment of wire into the latter. Hence, all mass and the drag of the feed reel have been compensated and the net effect of supplying air pressure through port 40 is to cause the feeder to push drawn wire 11 toward the consuming machine until the stop 13 for establishing the length of a drawn segment is reached. The action is essentially the same in cases where drawn wire is pulled into the consuming machine with feed rolls as mentioned earlier.

Figure 8:
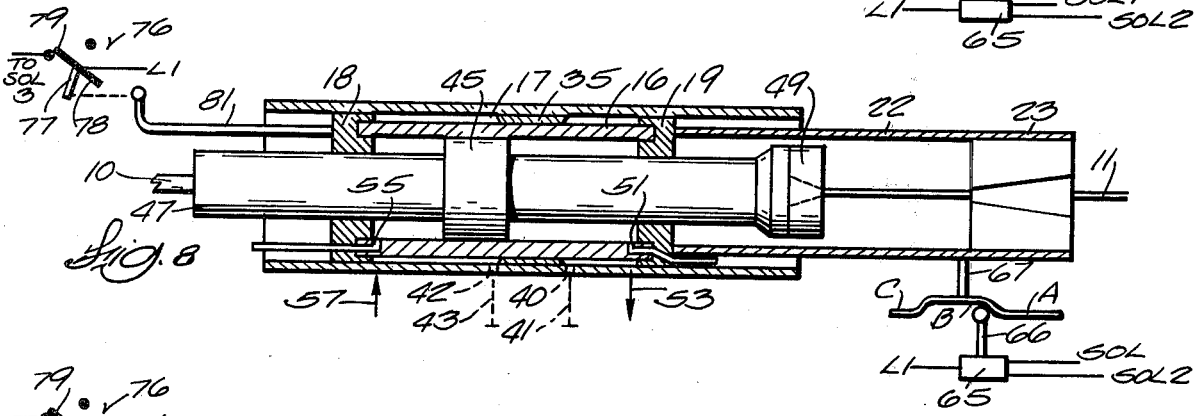

In FIG. 8, the wire feed cycle has progressed a little further such that air limit switch lever 66 is no longer depressed by cam A so limit switch 65 opens the contact through which SOL1 was formerly energized. This deenergization of SOL1 causes air valve 101 to switch to its centered and blocked position in which it is depicted in FIG. 5. This effectively blocks air ports 42 and 43 on both sides of annulus 35 in FIG. 8 and corresponds with the right end of line 103 in the FIG. 5A diagrams. Note that before the air supply through port 40 was cut off, port 42 was exhausting to the atmosphere so the air volume to the left of annulus 35 is at atmospheric pressure when port 42 becomes blocked along with port 40. Consequently, as cylinder 16 continues movement to the right, air pressure is building up on the left side of annulus 35 since end cap piston 18 is moving toward the annulus. This increasing pressure between end cap piston 18 and annulus 35 is demonstrated by line 107 in the FIG. 5A diagram ascending to the right. Pressure line 107 is still increasing at a time when the wire segment being fed to the consuming machine reaches the stop 13 in the machine. Hydraulic pressure is still being applied to the left side of piston 45 so it is doing most of the feeding at the moment. However, when the stop 13 is reached, it would seem on first impression that a shock would be transmitted to the drawer, that is, to piston 45, piston rod 47 and die 49 but such is not the case since the trapped air between end cap piston 18 and annulus 35 acts as a cushion and gently decelerates the whole mass.

Figure 9:
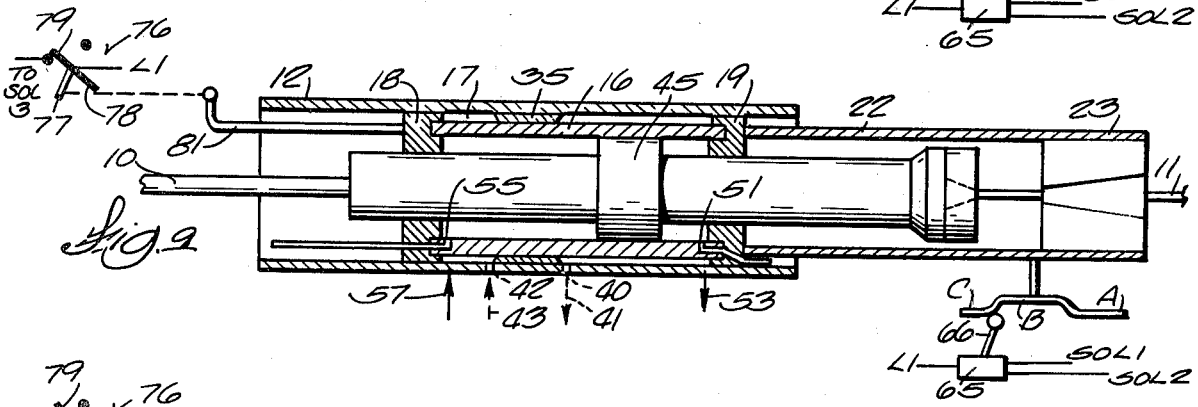

In FIG. 9, the feed stroke has been completed and cam C has run onto air limit switch level 65. This results in SOL2 of air valve 101 in FIG. 5 becoming energized and the valve body shifts to the left. Air line 43 and port 42 have now become pressurized and port 40 is exhausting into line 41. Thus air pressure is being applied from line 43 through port 42 to thereby develop full air pressure between end cap piston 18 and annulus 35 as shown by diagram line 106 in FIG. 5A. This begins to retract or drive feeder cylinder 16 to the left. Hydraulic piston 45 is still pressurized on its left side between it and end cap piston 18 and the die 49 has a bite on the wire so piston 45 stays where it is in FIG. 9. When feeder cylinder 16 is shifting left, cam C runs off air limit switch lever 66. This deenergizes SOL2 and causes air valve 101 to return to its centered and blocked position whereupon air becomes trapped on both sides of annulus 35 again. Air on the left side of annulus 35 is decreasing in pressure and on the right side is increasing in pressure after having started at atmospheric pressure just before valve 101 went to center and blocked. This air between annulus 35 and end cap piston 19 ultimately cushions the moving feeder cylinder 16 at the end of its retract to the left as was mentioned earlier.

Figure 10:
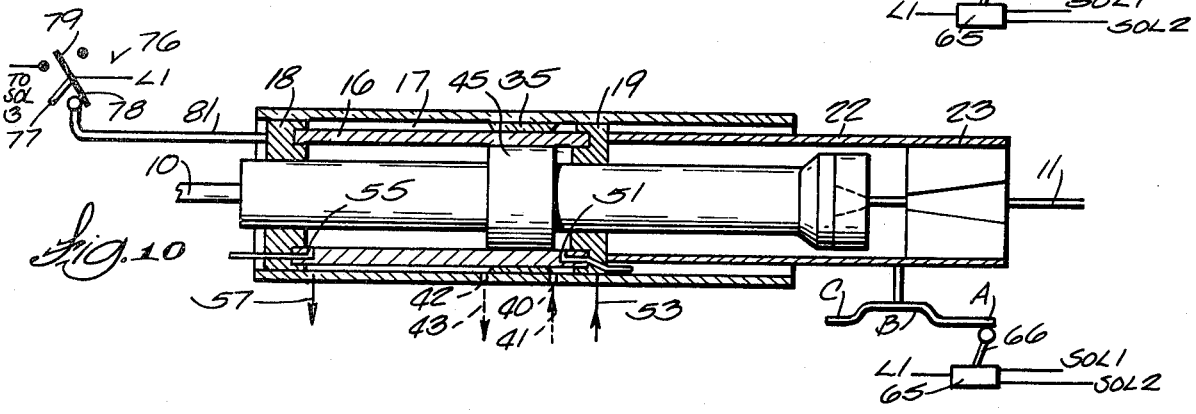

In FIG. 10, retract of the feeder cylinder 16 is complete and the device is ready to draw a length of wire for the next feed stroke. At full feeder retract, hydraulic limit switch 76 is opened again and SOL3 deenergizes so spring-return valve 88 shifts to the left again as it is shown in FIG. 5. This results in full fluid pressure being applied through line 53 and port 51 to the right side of hydraulic piston 45 and when the piston moves just a little, the gripper 23 grips the wire. As fluid pressure through port 51 continues, piston 45 and die 49 are driven left from their FIG. 10 position to their leftmost or home position again as in FIG. 6 so the device is, in a sense, cocked and ready to start another feed stroke.

Observe in FIG. 10 that at the beginning of the draw stroke, there is a minimum length piece of wire between die 49 and gripper 23. Hence, a lot of motion by the drawing die is not wasted by simply taking up the stretch of the wire between the die 49 and gripper 23 as is the case in some prior designs where the gripper is at the remote end of the feeder from the die. Also observe that when hydraulic piston 45 reaches either end of its stroke, it closes the slotted or three-hole ports in sequence, thereby obtaining a hydraulic cushioning effect and further contributing to smooth operation.

Another important but not too readily apparent feature of the new drawing device is that it always draws an amount of wire to return it to its cocked or starting position even if there is some slippage.

Another important feature is that the device can be made to operate so that the feeder cylinder 16 translates very little during a feed stroke which, as will be shown, amounts to the feeder accelerating a little bit, then coming to a gentle stop and followed by a reversal and again coming to a gentle or cushioned stop while the hydraulic piston 45 does the major part of the feeding work. This contributes to vibration free operation of the device. The process can be appreciated by reviewing FIGS. 7 and 8 in the operating sequence. Assume in FIG. 7 that the feeder cylinder 16 is being pushed to the right under the influence of air pressure developed in the space between annulus 35 and end cap piston 19. As explained earlier, at this time introduction of hydraulic fluid pressure through port 55 will be started and this will tend to retract cylinder 16 by virtue of pressure applied to its end cap 18 in the volume between the end cap and piston 45. The hydraulic fluid flow can be adjusted with flow control 91 such that the hydraulic forces which tend to drive the cylinder 16 to the left under present circumstances just balances the air pressure trapped between annulus 35 and end cap piston 19 which tends to drive cylinder 16 to the right. The net effect is to move hydraulic piston 45 to the right or pushing wire toward the consuming machine while cylinder 16 remains essentially stationary. Thus, hydraulic piston 45 will continue advancing to the right as in FIG. 8 and work cylinder 16 will be repeatedly returned to the left for the cam operated air control switch 65 to repeatedly put in a new charge of air to the left of annulus 35 while at the same time a new charge of pressurized hydraulic fluid will be delivered to the right side of piston 45 by virtue of hydraulic limit switch 76 being repeatedly operated. This will also result in piston 45 tending to return so as to thereby draw a little wire repeatedly. The amount of wire drawn will then be about equal to the amount of wire taken by the consuming machine during each feed step.

Although the preferred design which has been described in detail thus far, not only has all of the parts of the device moving linearly, but arranged concentrically, it will be appreciated by those skilled in the art that the basic principles of the new wire drawing device may be implemented with non-concentric parts and with the parts performing functionally converse to the manner in which they perform in the illustrated embodiment.

I claim:

1. A device for drawing and feeding drawn wire intermittently to a wire consuming machine, said device comprising:

a support member for being fixedly mounted and having a bore, wire feeder means including a cylinder having axially spaced apart first and second pistons thereon, said pistons being jointly axially reciprocable in sliding sealing fashion in said bore, and a wire gripper supported from said first piston at a fixed distance therefrom, said feeder means being advanceable toward and retractable away from said consuming machine, annular means surrounding said cylinder within said bore for defining isolated first and second air volumes, respectively, between said annular means and said first and second pistons, each of said volumes having a port communicating with it for admitting and exhausting air, respectively, on each side of said annular means, wire drawing means including a third piston reciprocable under the influence of hydraulic fluid inside of said cylinder means and a piston rod on which said third piston is fixed, said rod extending axially through said cylinder in sliding sealing fashion and having an axial hole coextensive with its length to provide a path for undrawn wire stock, said hole being aligned with the part of the gripper which grips the wire during drawing, said cylinder having port means for admitting and exhausting hydraulic fluid, respectively, on each side of said third piston, retaining means for a wire drawing die fixed at the end of said piston rod adjacent said first piston, a die in said means being operative to draw wire when being advanced in a direction away from said gripper and to engage with and feed wire when being retracted in a direction toward said gripper and consuming machine, air control means having input means for pressurized air, conduits for coupling said air control means to the respective ports communicating with the first and second air volumes in the cylinder of said feeder means, said air control means responding to said feeder means being retracted away from said consuming means by supplying air pressure through one conduit to said first volume between said first piston and annular means and permitting air exhaust from said second volume through the other conduit when said feeder means is retracted to initiate advancement thereof and responsive to said feeder means being advanced by supplying air pressure through said other conduit to said second volume between said second piston and annular means and permitting air exhaust through said one conduit from said first volume when said feeder means is advanced to initiate retraction thereof, said air control means being responsive to said feeder means being intermediate of retracted and advanced positions by discontinuing supplying air pressure to said first and second volumes when said feeder means has advanced and retracted a predetermined distance and to block exhaust of air from respectively alternate volumes for said air in said alternate volumes to undergo compression for decelerating said feeder means in a shock free manner at the end of its advancement and retraction strokes, hydraulic fluid control means having input means for pressurized hydraulic fluid, conduits for coupling said hydraulic fluid control means to the respective ports of said cylinder, said hydraulic fluid control means responding to said feeder means having advanced by said predetermined distance by supplying fluid pressure to one side of said third piston to aid in advancing said piston and to produce a reverse reactive force on said feeder means while said feeder means is being advanced by said air pressure to thereby cooperate with said feeder means in advancing drawn wire, said hydraulic fluid control means responding to said feeder means having been advanced to a limit and subsequently retracted by applying fluid pressure to the other side of said third piston for said fluid pressure to move said third piston in said cylinder in the retraction direction of said feeder means and thereby draw said die over said undrawn wire stock while said drawn wire is held by said gripper.

2. The device as in claim 1 wherein said hydraulic fluid port means extend axially a predetermined distance for being closed off gradually by movements of said third piston near the end of its stroke so as to decelerate said piston gradually.

3. The device as in claim 1 wherein said fixedly mounted support member has said ports that are in communication with said first and second volumes on opposite sides of said annular means, said air control means including an electrically operated valve means for selectively controlling the exhaust, blocking and pressurization of air through said ports.

4. The device as in claim 1 wherein said air control means comprises a double-acting dual-solenoid controlled valve means operative to supply air pressure to the first of said volumes while one of said solenoids is energized and to supply air pressure to the second of said volumes when the other of said solenoids is energized and is operative to block air input and exhaust to and from said volumes, respectively, when both of said solenoids are deenergized.

5. The device as in claim 4 including relatively movable cam means and switch means, one of said means being mounted on said feeder and the other being mounted stationarily, said switch means having operating means subject to operation by relative movement between said cam and switch means, said cam means controlling said switch means to effect energization of one of said solenoids when said feeder has retracted and to effect energization of the other of said solenoids when said feeder has advanced and to effect deenergization of both solenoids for blocking air flow to and from said volumes when said feeder is intermediate of being fully advanced or retracted.

6. The device as in claim 1 wherein said hydraulic fluid control means includes a single solenoid spring-returned hydraulic fluid valve, switch means operable to one state wherein it effects energization of said solenoid so it controls said valve to apply hydraulic fluid pressure to said third piston after advancement of said feeder is initiated and operable to a second state wherein it effects deenergization of said solenoid and enables the spring-return of said valve to control said valve to apply pressure to said third piston for advancing said piston to cause drawing of wire stock, and switch operating arm means on and movable with said feeder.

7. The device as in claim 1 including means for connecting a flexible tube to said piston rod for supplying lubricant material to said die through said axial hole in said rod.

8. The device as in any of claims 1, 2, 3, 4, 5, 6 or 7 wherein said air control means includes means for use when said device is being set up for cooperating with a particular wire consuming machine to adjust the air pressure supplied to at least said first volume to a level wherein said pressure is just sufficient to advance said feeder and drawer means together toward said consuming machine while wire is being fed into said consuming machine and simultaneously being withdrawn from a source of wire stock such as to balance out any resistive forces which would otherwise be imposed on the device during its regular operation by any wire source, or the consuming machine or the mass of the drawer and feeder.

9. A device for taking rod from a source and for drawing said rod into wire and feeding wire intermittently to a wire consuming machine, said device comprising:

a wire feeder unit including wire gripper means and a wire drawing unit including drawing die means, said die and gripper means being alternately advanceable and retractable relative to each other for successively drawing and feeding wire, said feeder unit comprising a stationary member having a bore and a radially inwardly extending annular element fixed in said bore, a cylinder for advancing and retracting axially and sealingly through said annular element, axially spaced apart first and second pistons on said cylinder on axially opposite sides of said annular element, said pistons respectively defining first and second variable volume air chambers in conjunction with said annular element and said bore when said pistons and cylinder of said feeder unit advance jointly toward and retract from said consuming machine, said bore having a first and a second port each of which is for selectively admitting and exhausting air to and from said first and second variable volume air chambers, respectively, said wire gripper being mounted to said cylinder at a fixed spacing therefrom, said drawing unit comprising a piston rod extending axially and in sliding sealing relation through said cylinder, a piston on said rod for reciprocating in said cylinder and defining first and second hydraulic fluid chambers therein, said drawing die means being mounted to said piston rod at an end adjacent said gripper means and said piston rod being hollow for undrawn rod to extend therethrough to said die, said cylinder having first and second ports for selectively admitting and exhausting hydraulic fluid to and from said fluid chambers, an air control valve having an input port for being coupled to a source of pressurized air and having other ports, and conduits for coupling said other ports to said first and second ports leading to said air chambers, respectively, a hydraulic fluid control valve having an input port for being coupled to a source of pressurized hydraulic fluid and other ports, and conduits for coupling said last named other ports to said first and second ports leading to said fluid chambers, respectively, means responsive to the position of the feeder unit by controlling said control valve to admit pressurized air to said first chamber on one side of said annular element when said cylinder of the feeder away from said wire consuming machine is retracted to cause said cylinder to advance while said second chamber is exhausting and to admit pressurized air to said second chamber on the other side of said annular element when said cylinder is advanced to cause said cylinder to retract while said first chamber is exhausting, and said means also responding to said cylinder having been advanced or retracted a predetermined distance by further controlling said air valve to discontinue admitting said air and to block exhaust of air from said chambers to thereby trap air in the chamber other than the one which was last pressurized and cushion stopping of said cylinder at the ends of its movement, said hydraulic piston, its piston rod and the die being movable with said cylinder for cooperating to feed drawn wire to said consuming machine when said cylinder is advancing, means responsive to said cylinder having reached an advanced position limit by controlling said hydraulic fluid control valve to admit pressurized fluid to said first fluid chamber inside of said cylinder for retracting said piston to draw a length of wire with said die when said cylinder is retracted and said gripper is gripping and responsive to said cylinder of the feeder advancing a predetermined distance by controlling said valve to admit pressurized fluid to said second fluid chamber at a predetermined time after said cylinder of the feeder has begun to advance for feeding wire to said consuming machine such that said piston and said cylinder initially move together while said fluid pressure is maintained in said first chamber and then said fluid pressure in said second chamber begins to advance said piston in said cylinder and said die thereon toward said gripper.

10. The device as in claim 9 including:

means for adjusting said source air pressure to a level where, when said die has a bite on said rod for pushing drawn wire into said consuming machine and said rod is being taken from its source, said pressure exerts at least sufficient force on said first piston to advance said feeder and drawer units and thereby balance the inertia of said units and rod source and any resistance of said consuming machine to input of wire.

11. The device as in any of claims 9 or 10 wherein said means for controlling said air valve comprises:

switch means adjacent the linear path in which said feeder unit reciprocates, said air control valve having first and second solenoids, said valve responding to energization of the first of said solenoids by admitting said air pressure between said first air piston and said annular element and responding to energization of the second of said solenoids by admitting air pressure between said second air piston and said annular element, said valve responding to deenergization of both of said solenoids by blocking air against discharge between both of said pistons and annular element simultaneously, cam means mounted to said feeder unit and movable along said linear path to operate said switch means.

* * * * *